United States Patent [19]

Pottorff

[11] Patent Number: 4,898,082

[45] Date of Patent: Feb. 6, 1990

[54] MOLDED PLASTIC AIR CYLINDER

[76] Inventor: Earl T. Pottorff, 2346 Taylor Rd., Savannah, N.Y. 13146

[21] Appl. No.: 242,528

[22] Filed: Sep. 12, 1988

[51] Int. Cl.[4] ..... F01B 31/00

[52] U.S. Cl. ..... 92/132; 92/85 A; 92/130 R; 92/169.1; 92/170.1; 92/248; 92/249; 277/152; 277/153; 277/205

[58] Field of Search ..... 92/61, 85 R, 85 B, 130 R, 92/132, 143, 169, 170, 248, 249, 85 A; 277/152, 153, 205

[56] References Cited

U.S. PATENT DOCUMENTS

| | | | |
|---|---|---|---|
| 3,040,712 | 6/1962 | Harrah | 92/170 |
| 3,176,595 | 4/1965 | Schwartz | 92/249 |
| 3,913,460 | 10/1975 | Wright | 277/205 |
| 4,009,645 | 3/1977 | Freimuth | 92/249 |
| 4,195,849 | 4/1980 | Taft | 277/205 |
| 4,207,807 | 6/1980 | Takata et al. | 92/170 |
| 4,651,623 | 3/1987 | Rogers | 92/249 |
| 4,667,780 | 5/1987 | Pauliukonis | 92/170 |

FOREIGN PATENT DOCUMENTS

| | | | |
|---|---|---|---|
| 1173764 | 3/1959 | France | 92/130 |
| 644719 | 9/1962 | Italy | 92/249 |

*Primary Examiner*—Robert E. Garrett
*Assistant Examiner*—Thomas Denion
*Attorney, Agent, or Firm*—Wall and Roehrig

[57] ABSTRACT

A plastic pneumatic cylinder has a cylinder housing, a piston within the housing, and a rod on which the piston is mounted. The cylinder is molded of a plastic synthetic resin and has a cylindrical bore of a predetermined diameter. The piston is molded in one piece from plastic synthetic resin, such as Delrin, in the form of a generally cylindrical body and a generally cylindrical sealing lip surronding and spaced radially from the body to seal slidably against the bore. The lip is flared out somewhat to have an edge that is of a greater diameter than the bore. The piston can be formed in single-acting or double-acting configurations. A conical return spring can be employed.

11 Claims, 1 Drawing Sheet

MOLDED PLASTIC AIR CYLINDER

BACKGROUND OF THE INVENTION

This invention relates to air motors, and in particular to pneumatic cylinders. The invention is more specifically directed to a pneumatic cylinder in which the cylinder housing and the piston are made of plastic synthetic resin.

Conventional pneumatic cylinders are invariably of metal, as is the piston. A separate sealing member which can be rubber, leather, or another material is carried on the cylinder to piston to make a sliding seal between the piston and the wall of the cylinder bore.

Pneumatic cylinders are used extensively in the manufacture of polyfilm products, for example, for operating blades and punches for perforating plastic film bags and the like. These cylinders typically operate at high speed for extended intervals. Pneumatic cylinders typically generate high levels of noise as well. With conventional pneumatic equipment it is difficult to meet the noise standard of the Occupational Safety and Health Administration (OSHA), which does not permit noise in the workplace to exceed a level of 82 dBA. Where there are large numbers of these cylinders operating at the same time, such as in the manufacture of plastic film products, it is virtually impossible to meet the standard without employing numerous acoustic baffles and sound absorption materials over the machinery.

Conventional cylinders are also rather time consuming to repair when repairs are necessary, but are too expensive simply to replace and discard.

OBJECTS AND SUMMARY OF THE INVENTION

Accordingly, it is one object of this invention to provide a pneumatic cylinder which avoids the drawbacks of the prior art.

It is another object of this invention to provide a pneumatic cylinder which operates at a significantly reduced noise level.

It is a still further object of this invention to provide a pneumatic cylinder made of low cost, molded plastic synthetic resin.

It is another object of this invention to provide a pneumatic cylinder which can operate at higher speeds than conventional pneumatic cylinders.

In accordance with one aspect of this invention, a plastic pneumatic cylinder device is formed of a plastic cylinder housing, a plastic piston within the housing, and a piston rod on which the piston is mounted and which projects axially from the housing. The cylinder housing has a cylindrical bore of a predetermined diameter and a compressed air inlet at one end for admitting air pressure from a compressed air source into the bore. A spring or other means in the cylinder housing urges the piston and the rod in the other direction when air pressure is relieved. This piston is a one-piece molded plastic piston formed of a generally cylindrical body. A generally cylindrical sealing lip or skirt that surrounds and is spaced from the piston body for slidably sealing against the bore. This sealing lip is flared out so that its edge is of a greater natural diameter, preferably by about 15–20 mils, than the cylinder bore. By natural diameter, it is meant the diameter of the lips when unconstrained by the wall of the cylinder bore. The cylinder device can be constructed as single acting or double acting.

The device of this invention has the advantages of low wear, long life, low initial cost, and easy replacement. Because of the low weight of the plastic piston, the parts of the cylinder have significantly lower inertia than conventional pneumatic devices, so that higher speed operation and faster cycle times are possible. The piston with its unitarily molded sealing lip is also much less likely to fail than conventional pistons with separate gasket or washer.

The above and many other objects, features and advantages of this invention will be more fully understood from the ensuing description of a preferred embodiment, which should be read in connection with the accompanying Drawing.

DETAILED DESCRIPTION OF A PREFERRED EMBODIMENT

Figure 1:
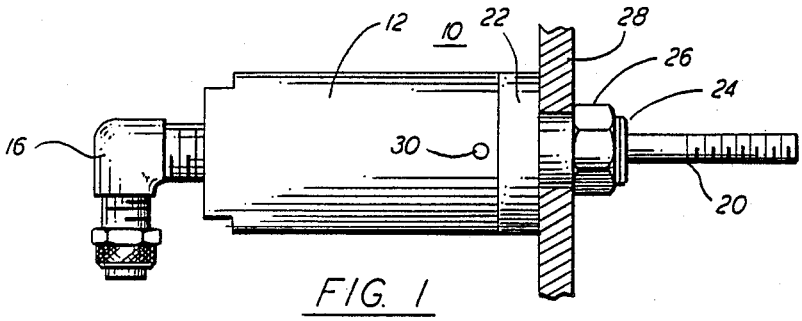
FIG. 1 is a side elevation of a molded plastic pneumatic cylinder according to a preferred embodiment of this invention.
Figure 2:
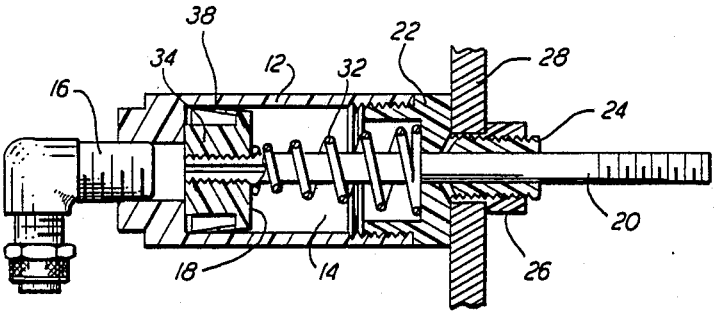
FIG. 2 is a sectional elevation of the pneumatic cylinder device of FIG. 1.

With reference to the Drawing, and initially to FIGS. 1 and 2, an air cylinder 10 has a molded plastic cylindrical housing 12 with a cylindrical bore 14 of diameter d. An air fitting 16 is fitted to an opening on the housing axis at the proximal end for admitting air pressure into the bore 14. Within the bore is a one-piece molded plastic piston 18 which is affixed onto a piston rod 20. The rod 20 can also be molded plastic, or can be metal. A closure 22 at the distal end of the cylindrical housing 12 closes the cylinder and has a threaded stem 24 by means of which a nut 26 can attach the cylinder 10 to a support 28, which can be part of a larger machine, not shown.

In this embodiment, there are one or more relief ports 30 molded into the wall of the cylindrical housing 12 at its distal end.

A compression spring 32 is situated over the rod 20 between the piston 18 and the closure 22 for urging the piston 18 to the proximal end of the bore 14 when air pressure is relieved. Preferably, the spring 32 is conical, rather than helical. With a conical coil, the coils do not close against one another when the piston moves distally, so that there is less noise than with a helical coil.

Figure 3:
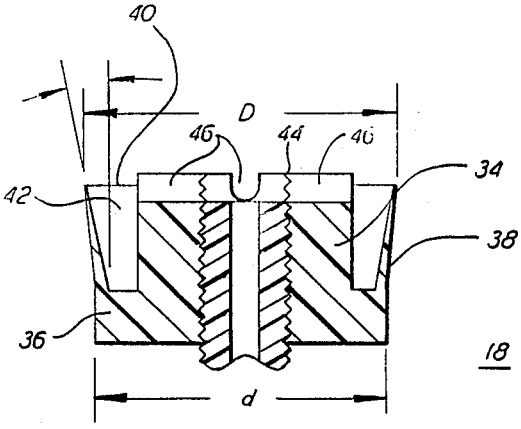
FIG. 3 is an enlarged sectional view of the one-piece molded plastic piston as employed in the device of FIGS. 1 and 2.

As shown in FIG. 3, the piston 18 has a generally cylindrical body 34 with a shoulder of a diameter approximately that of a bore 14. A generally cylindrical sealing lip 38 rises from the shoulder 36 in the form of a skirt 38 that is flared outwards somewhat to a proximal edge 40. The sealing lip 38 has a diameter D at the edge 40 about 15–20 mils greater than the diameter d of the bore.

The lip 38 is spaced somewhat from the cylinder body 34 leaving an annular void 42 or spacing therebetween.

When the one-piece piston 18 is molded, the lip or skirt 38 is straight sided as it leaves the mold. However, because of the thinness of the skirt 38 relative to that of the shoulder 36 and the body 34, material in the skirt will tend to cool much faster than elsewhere. Generally, the molded plastic material will shrink as it cools, but because the skirt cools faster at the proximal edge than at the shoulder 36, there is less shrinkage at the edge. This produces a natural taper, as shown. Also preferably, as shown, the wall thickness of the sealing, lip or skirt 30 diminishes gradually from the shoulder 36 to the proximal edge 40.

A proximal nose 44 of the piston body 34 projects axially beyond the edge 40 of the lip. This feature prevents the lip 38 from striking the proximal end of the bore 14, and thus prevents damage to the lip. A number of open, radial channels 46 are provided at the nose 44 of the piston body 34. These open into the annular void 42 from the axis of the piston 18. This feature permits compressed air to pass directly from the fitting 16 to the lip 38 to urge the same against the bore. In a preferred embodiment, there are four such channels 44 ninety degrees apart.

Figure 4:
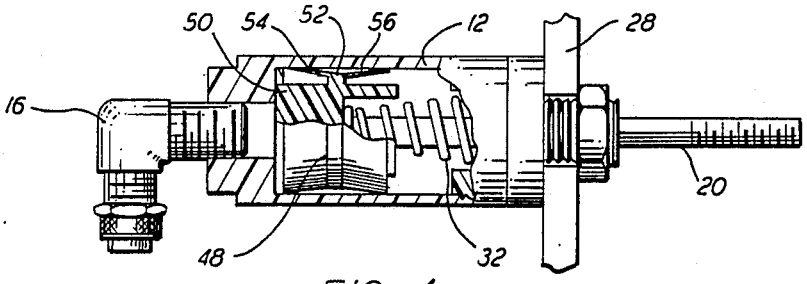
FIG. 4 is an elevational view, partly in section, illustrating an alternative embodiment of this invention.

As shown in FIG. 4, the air cylinder 10 can be double acting, with means (not shown) for applying compressed air at the distal, as well at the proximal end. In the pneumatic cylinder shown in FIG. 4, the same reference numbers are used as previously to identify the same elements. Here, a double-acting piston 48 is unitarily formed of a body 50 having a shoulder 52 from which there extends a proximal side sealing skirt 54 and a distal-side sealing skirt 56. Both of these sealing skirts 54,56 have the structure and function generally the same as that of the sealing lip or skirt 38 of the first embodiment but disposed back-to-back. The double acting cylinder can be provided either with or without the spring 32, as may suit the intended end application.

Preferably, the cylindrical housing 12 and the piston 18 or 48 are molded of a semi-rigid polymer such as Delrin, which is an acetal homopolymer. Because the pistons are molded in one piece, the air cylinder units 10 can be provided at extremely low cost, making it an inexpensive and simple matter to replace broken or failed air cylinders, rather than to attempt to repair them. These plastic air cylinders will also meet OSHA noise level requirements. These cylinders always run below the 82 dBA noise threshold. The air cylinders embodying this invention typically run at noise levels between 70 and 74 dBA, and in many test runs at levels between 60 and 70 dBA.

While this invention has been described in detail with reference to certain preferred embodiments, it should be understood that this invention is not limited to those precise embodiments. Rather, many modifications and variations could be effected by those of skill in the art without departing from the scope and spirit of this invention, as defined in the appended claims.

What is claimed is:

1. A plastic pneumatic cylinder device comprising a cylinder housing, a piston within said housing, and a rod on which the piston is mounted projecting axially from the housing; wherein said cylinder housing has a cylindrical bore of a predetermined diameter and a compressed air inlet at one end of the cylinder for admitting air pressure from a compressed air source into the bore to urge the piston and rod in one direction, with means in said cylinder housing to urge the piston and rod in the other direction when said air pressure is relieved; wherein said piston is a one-piece plastic piston molded entirely of a semi-rigid polymer, including a generally cylindrical body and a generally cylindrical sealing skirt surrounding and spaced radially from said body to seal slidably against said bore, said skirt being flared out to have an edge that is of a greater natural diameter than said borer; and wherein said cylinder housing is molded of said semi-rigid polymer including a molded closure of said semi-rigid polymer which fits onto said cylinder housing to contain said piston, said pneumatic cylinder device including means to ensure that said air pressure passes to said skirt to urge the same against said bore when the piston is urged against the inlet end of the bore.

2. The plastic pneumatic cylinder device of claim 1 wherein said semi-rigid polymer is an acetal homopolymer.

3. The plastic pneumatic cylinder device of claim 1 wherein said piston sealing lip extends axially in the direction of said compressed air inlet.

4. The plastic pneumatic cylinder device of claim 3 wherein said body extends axially beyond the edge of the lip to block the lip from contacting ends of the cylinder bore.

5. The plastic pneumatic cylinder device of claim 1 wherein said means for urging the piston and the rod in the other direction includes a coil compression spring disposed over said rod.

6. The plastic pneumatic cylinder device of claim 5 wherein said spring is a conical spring.

7. The plastic pneumatic cylinder device of claim 1 wherein the diameter of sealing lip edge is about 15–20 mils larger than the diameter of the bore.

8. The plastic pneumatic cylinder device of claim 1 wherein said piston is double acting and comprises a second generally cylindrical sealing lip disposed back to back with said first lip and unitarily molded with said body and surrounding and spaced radially therefrom, the lip being flared out to have an edge that is of greater natural diameter than said bore.

9. The plastic pneumatic cylinder device of claim 1 wherein said piston body includes a radially projecting shoulder on which said sealing lip is formed.

10. A plastic pneumatic cylinder device comprising a cylinder housing, a piston within said housing, and a rod on which the piston is mounted projecting axially from the housing; wherein said cylinder housing has a cylindrical bore of a predetermined diameter and a compressed air inlet at one end of the cylinder for admitting air pressure from a compressed air source into the bore to urge the piston and rod in one direction, with means in the cylinder housing to urge the piston and rod in the other direction when said air pressure is relieved and wherein said piston is a one-piece molded plastic piston including a generally cylindrical body and a generally cylindrical sealing lip surrounding and spaced radially from said body to seal slidably against said bore, said lip being flared out to have an edge that is of a greater natural diameter than said bore, said piston sealing lip extending axially in the direction of said compressed air inlet, wherein said piston body extends axially beyond the edge of the lip to block the lip from contacting ends of the cylinder bore, and wherein said piston body has, at its end that faces the air inlet, a plurality of channels that radiate from the axis to permit air to pass directly to the sealing lip when the piston is urged against the inlet end of the bore.

11. A plastic pneumatic cylinder device comprising a cylinder housing, a piston within said housing, and a rod on which the piston is mounted projecting axially from the housing; wherein the cylinder housing has a cylindrical bore of a predetermined diameter and a compressed air inlet at one end of the cylinder for admitting air pressure from a compressed air source into the bore to urge the piston and rod in one direction, with means in said cylinder housing to urge the piston and rod in the other direction when said air pressure is relieved; wherein said piston is a one-piece molded plastic piston including a generally cylindrical body and a generally cylindrical sealing skirt surrounding and spaced radially from said body to seal slidably against said bore, said skirt being flared out to have an edge that is of a greater natural diameter than said bore; wherein said piston body includes a radially projecting shoulder on which said sealing skirt is formed, said sealing lip being in the form of a cylindrical skirt rising from said shoulder from an inner radius spaced out from the piston body so that an annular void is maintained from said shoulder up to the edge of said sealing skirt, and wherein said skirt has a progressively smaller thickness from said shoulder to said edge.

* * * * *